US005112152A

United States Patent [19]

McBride

[11] Patent Number: 5,112,152

[45] Date of Patent: May 12, 1992

[54] COMBINATION APPLICATOR AND PACKAGE

[76] Inventor: Carla McBride, 1318 Tamm, St. Louis, Mo. 63139

[21] Appl. No.: 663,790

[22] Filed: Mar. 4, 1991

Related U.S. Application Data

[63] Continuation of Ser. No. 308,038, Feb. 8, 1989, abandoned.

[51] Int. Cl.[5] ..... B43K 5/14

[52] U.S. Cl. ..... 401/132; 401/118; 206/209; 206/229; 206/361

[58] Field of Search ..... 401/49, 132, 196; 604/1-3; 206/385, 438, 581, 620, 209, 210, 229, 361; 383/38; 132/320; 15/104.94

[56] References Cited

U.S. PATENT DOCUMENTS

| | | | |
|---|---|---|---|
| 2,038,845 | 4/1936 | Locke, Jr. | 206/581 |
| 2,060,513 | 11/1936 | Marx | 206/229 |
| 2,534,100 | 12/1950 | Baumgartner | 206/229 |
| 2,547,779 | 4/1951 | Rencyk | 401/132 X |
| 2,551,679 | 5/1951 | Johnson | 206/192 |
| 2,639,806 | 5/1953 | Recht | 206/229 |
| 2,684,178 | 7/1954 | Keeler | 206/192 |
| 2,775,246 | 12/1956 | Morrell | 206/229 |
| 2,902,146 | 9/1959 | Doherty | 604/1 X |
| 2,927,713 | 3/1960 | Buttery et al. | 206/229 |
| 3,369,267 | 2/1968 | Friedland et al. | 401/132 X |
| 3,759,375 | 9/1973 | Nappi | 401/132 X |
| 3,835,834 | 9/1974 | Brown et al. | 604/1 X |
| 3,869,062 | 3/1975 | Jaeschke et al. | 206/229 |
| 4,211,323 | 7/1980 | Olsen | 604/3 X |
| 4,283,809 | 8/1981 | Prost | 604/1 X |
| 4,838,851 | 6/1989 | Shabo | 604/1 |

FOREIGN PATENT DOCUMENTS

| | | | |
|---|---|---|---|
| 427427 | 4/1926 | Fed. Rep. of Germany | 604/1 |

*Primary Examiner*—Richard J. Apley
*Assistant Examiner*—D. F. Crosby
*Attorney, Agent, or Firm*—Heller & Kepler

[57] ABSTRACT

An applicator and package combination preferably for single shoe polish applications, has at least one sealed chamber and an applicator in the chamber. The chamber remains sealed until a user requires a polish application. The package opens initially to provide access to the applicator without exposing the user to the polish, thereby reducing waste and drying out of the polish applicator. The packages can be provided in separable strips of any reasonable and easily stored number for both use and carrying about the user.

22 Claims, 2 Drawing Sheets

COMBINATION APPLICATOR AND PACKAGE

This is a continuation of copending application(s) Ser. No. 07/308,038 filed on Feb. 8, 1989, now abandoned.

BACKGROUND OF THE INVENTION

The present invention relates in general to a combination applicator and package, more particularly, to an applicator and package combination for a one-time application of shoe polish. The applicator and package combination of this invention provides for increased shelf life and ease of use over conventional applicators.

With the conventional polish applicator it is generally necessary to apply the polish from a large bottle or other container. The polish is typically a liquid and application to one's shoes requires care in order to avoid spills or stains.

Use of the container or bottle is particularly annoying for touch up requirements. When just a dab or quick swab of polish is required most would rather do without. However, in some professions the shoes are part of a uniform and neatness and appearance can often be a continuing requirement. Both the professional and the occasional user would benefit from an applicator that could be conveniently stored until needed and then applied with little mess and finally discarded.

Accordingly, it is an object of the present invention to provide an applicator and package combination having a sealed chamber or pocket for containing the applicator.

Another object of the present invention is to provide an applicator and package combination that can be opened to provide access to an applicator without opening the sealed chamber or pocket.

A further object of the present invention is to provide an applicator and package combination including multiple sealed chambers. The sealed chambers or pockets provide for extended polish shelf life and access to the applicator with a minimum of mess.

Still another object of the present invention is to provide an applicator and package combination that includes a swab and a holding or handle portion. The handle is accessible upon initially opening the package prior to breaking the seal of the chamber or pocket.

Still a further object of the present invention is to provide an applicator and package combination that includes an internal barrier or wall portion. The barrier or wall provides a seal against leakage of a flowable material such as shoe polish from a chamber or pocket.

Another object of the present invention is to provide an applicator and package combination that is comprised of leaves and the leaves are sealed together in order to provide at least one sealed pocket or chamber in each package or envelope. The envelopes can be attached in strips of separable multiple envelopes for user convenience.

A further object of the present invention is to provide an applicator and package combination that includes a liquid absorbing, small pore and dense swab material. The swab shape preferrably allows different width application of the liquid, polish or other suitable flowable material.

SUMMARY OF THE INVENTION

To accomplish the foregoing and other objects of this invention there is provided an envelope including at least one sealed chamber and an applicator sealed in the envelope. The front and rear leaves of the envelope define at least one sealed chamber. The applicator is sealed in the chamber. A plurality of opening methods on the preferred embodiments provide access to the sealed chamber and the applicator while not initially opening the sealed chamber, thereby substantially reducing leakage and waste of the material in the sealed chamber and on the applicator. Multiple chamber embodiments are also provided for various applicator and sealed chamber combinations. At least one preferred embodiment includes an applicator extension that further provides for ease of use of the present invention. The preferred embodiments include the sealed chamber or chambers formed by sealing the envelope margins and intermediate sealed portions. One preferred embodiment includes a barrier or wall within a sealed chamber.

These and other objects and features of the present invention will be better understood and appreciated from the following detailed description of preferred embodiments thereof, selected for purposes of illustration and shown in the accompanying drawings.

DETAILED DESCRIPTION

Figure 1:
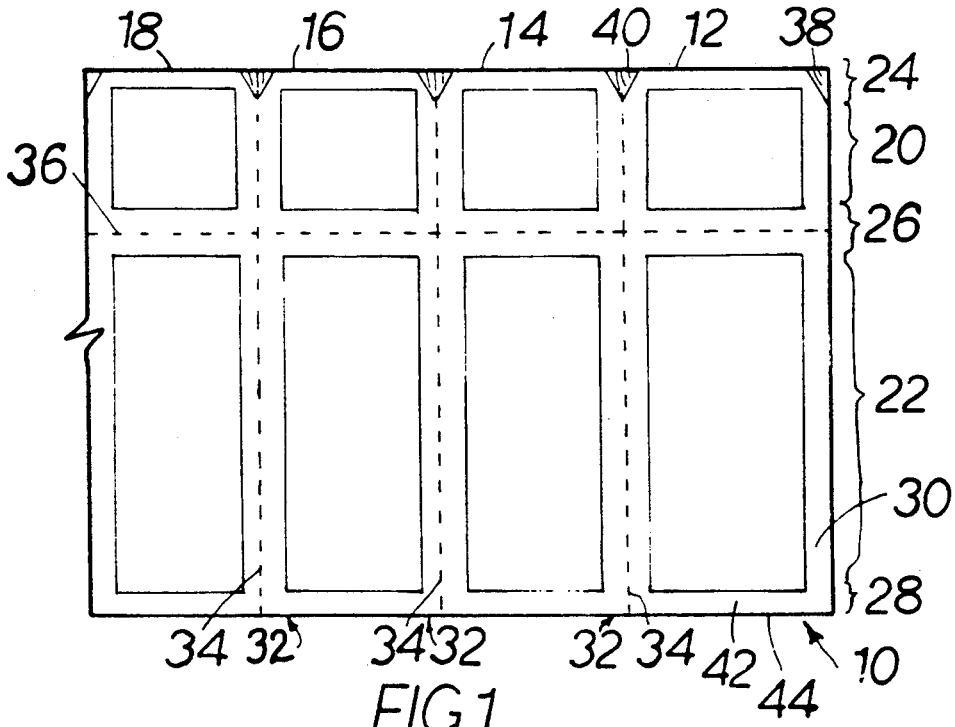
FIG. 1 is a plan view of a combination of packages of a preferred embodiment of the present invention.

Referring now to the drawings there is shown a number of preferred embodiments for the package and applicator of this invention. The package is described in connection with a shoe polish applicator. The applicator and package of the present invention is particularly adapted for providing a single use shoe polish applicator for a generally flowable polish and is characterized by an improved ease of use and reduced spillage and waste.

The drawings show a strip of packages 10 including a plurality of envelope means represented in this embodiment as packages 12, 14, 16, and 18. The embodiment illustrated in FIG. 1 includes the separable strip of envelopes or packages each having a top portion 20 and a bottom portion 22. The envelopes are typically sealed and separated into the various chambers by a top sealed margin strip 24, an intermediate sealed strip 26, a bottom sealed margin strip 28, and a sealed end strip 30 at either end of the strip of envelopes. A plurality of intermediated sealed margin strips 32 separate the individual envelopes.

In a package or strip of envelopes as illustrated in FIG. 1, a plurality of longitudinal separation means 34 provides for separation of the individual envelopes. Typical separation means include a series of perforations as illustrated in the drawing figures. Each envelope in the strip of envelopes includes a transverse separation means, for example, the transverse perforations illustrated in the drawings.

Each envelope or package includes an opening means 38 and can further include an opposing opening means 40 as illustrated in FIG. 1. The preferred locations and purpose of these opening means will be further described below with respect to the individually described embodiments of the present invention.

The opening means provides for separation of the leaves allowing access to the applicator means. The top portion 20 of the envelope can be removed by tearing along transverse separation means 36. It is intended that the applicator means can then be removed from the bottom envelope bottom portion 22. Transverse separation means 36 is applicable, although not shown, with respect to the preferred embodiments hereinafter described.

Figure 2:
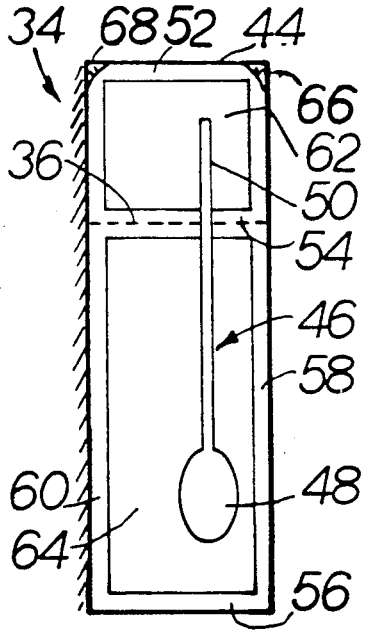
FIG. 2 is a cutaway plan view of one package illustrated in FIG. 1.

Referring now generally to FIGS. 2 through 5, an envelope or package of a preferred embodiment of the present invention is illustrated. The package has a front leaf 42 (shown in FIG. 1) and a rear leaf 44 as illustrated in FIG. 2. An applicator means 46 within the package includes a swabbing means such as a swab 48 which can be a wedge of foam material as further described below. The applicator means further includes a holding means such as an applicator rod 50.

The front and rear leaves are sealed together along an upper sealing means, an intermediate sealing means, a lower sealing means, one longitudinal sealing means, and an opposing longitudinal sealing means. An upper chamber means and a lower chamber means are thus defined.

The preferred embodiment includes an upper marginal transverse adhesive strip 52, an intermediate transverse adhesive strip 54, and a lower marginal transverse adhesive strip 56. The edge seals complete envelope closure and creation of at least two chambers. They include one longitudinal marginal adhesive strip 58 and another longitudinal marginal adhesive strip 60. These sealed portions define an upper pocket 62 and a lower pocket 64.

Opening means are provided in this embodiment at one openable corner 66 and an opposing openable corner 68. The drawings suggest one practice for providing these opening means. A suitable adhesive used to provide sealing of the transverse and longitudinal strips is not applied at the apex of the corners. This leaves a separable portion of the front and rear leaves at these corners. The user can easily insert a finger or thumb nail or other relatively thin object between the front and back leaves, grip the corners, and open the package. It will be noted that the package provides an opening means that reveals and provides access to the applicator without breaking the seal of the lower pocket which holds the swab and swabbable material, such as liquid shoe polish in the preferred embodiments.

Other preferred embodiments of the present invention will now be described. All of the described embodiments illustrate the features of the present invention that combine so as to allow the polish to remain in a sealed pocket while a user accesses and prepares to use the applicator.

Figure 3:
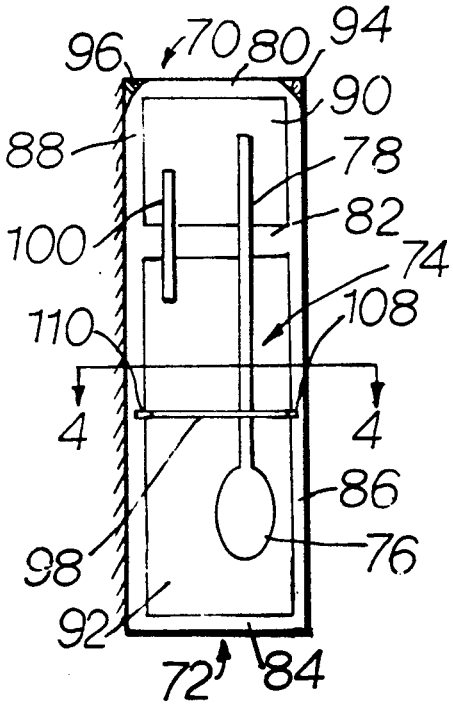
FIG. 3 is a cutaway plan view of another embodiment of the present invention.

Referring now to FIG. 3 there will be seen another preferred embodiment of the present invention in which the material, such as shoe polish, in a lower chamber is further sealed within the chamber. Only the rear leaf 72 of package 70 is illustrated for purposes of clarity.

The package 70 also contains its associated applicator means 74 including swabbing means and holding means. The swabbing means includes a swab 76 and the applicator means includes an applicator rod 78.

The package 70 is typically formed by front and rear leaves sealed together along an upper sealing means, an intermediate sealing means, a lower sealing means, one longitudinal sealing means, and an opposing longitudinal sealing means. An upper chamber means and a lower chamber means are thus defined.

The preferred embodiment includes an upper marginal transverse adhesive strip 80, an intermediate transverse adhesive strip 82, and a lower marginal transverse adhesive strip 84. The edge seals complete envelope closure and creation of at least two chambers. They include one longitudinal marginal adhesive strip 86 and another longitudinal marginal adhesive strip 88. These sealed portions define an upper pocket 90 and a lower pocket 92.

Opening means are provided in this preferred embodiment at one openable corner 94 and an opposing openable corner 96 provided as previously described.

The preferred embodiment of FIG. 3 includes a barrier means in lower pocket 92. The barrier means can be a wall 98 enclosed within the lower pocket 92. The wall defines an aperture 102 suitable for receiving the applicator rod 78. The barrier means located within at least one chamber means provides a barrier or a wall to seal the chamber against leakage from the applicator means, whereby the barrier within the chamber means provides protection against leakage subsequent to opening the envelope and before removing the applicator means in order that the applicator means removal is generally free from contamination by a material intended to be restricted to the chamber means prior to applicator means removal.

Figure 4:
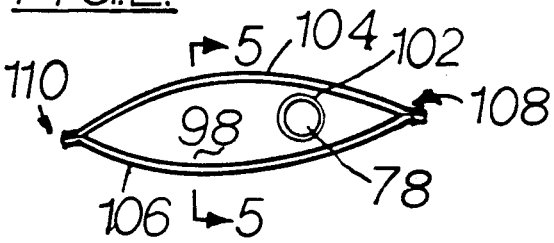
FIG. 4 is a cross-sectional view taken along line 4—4 in FIG. 3.
Figure 5:
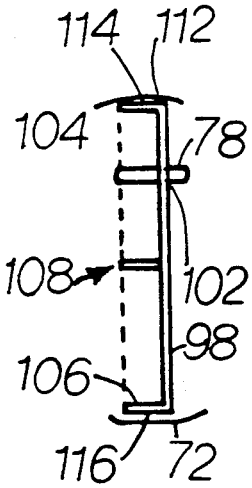
FIG. 5 is a cross-sectional view taken along line 5—5 in FIG. 4.

The barrier means includes marginal sealing means and opposing marginal sealing means. The preferred embodiment illustrated includes a flange 104 and another and opposing flange 106. FIGS. 4 and 5 illustrate a typical barrier profile and opposing flanges. It will be further observed that compressed sealing means and opposing compressed sealing means are formed where the marginal sealing means converge at the sides of the lower pocket. These opposing end portions 108 and 110 provide a seal at the opposing ends of the wall member 98.

Referring more specifically to FIG. 5 it will be understood that opposing flanges 104 and 106 can include adhesive zones 114 and 116 intermediate front leaf 112 and rear leaf 72, respectively.

The preferred embodiment illustrated in FIG. 3 introduces a variation of this and other preferred embodiments and illustrated in later of the drawing figures. The variation is an application means extension or holding rod extender. The extension further insures that the applicator can be used with a minimum of spillage, waste or mess by providing the user with means for engaging the applicator rod 78 prior to rupturing the lower sealed pocket 92. The extension 100 further provides additional ease of application by not requiring the user to bend over quite so far while applying the shoe polish.

Typically, the end of the applicator rod is prepared for receiving and holding the extension 100. The end of the applicator rod 78 can be grooved so as to provide a gripping surface between the rod 78 and extension 100. Other means of increasing grip between rod and extension 100 will be readily apparent to one skilled in the art.

Figure 6:
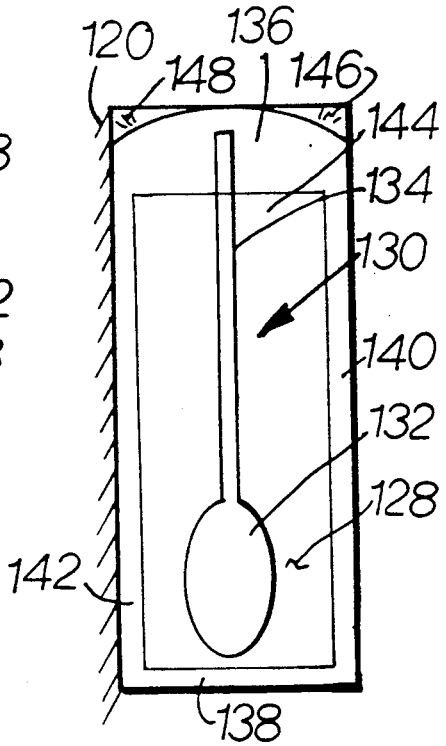
FIG. 6 is a cutaway plan view of another embodiment of the present invention.
Figure 7:
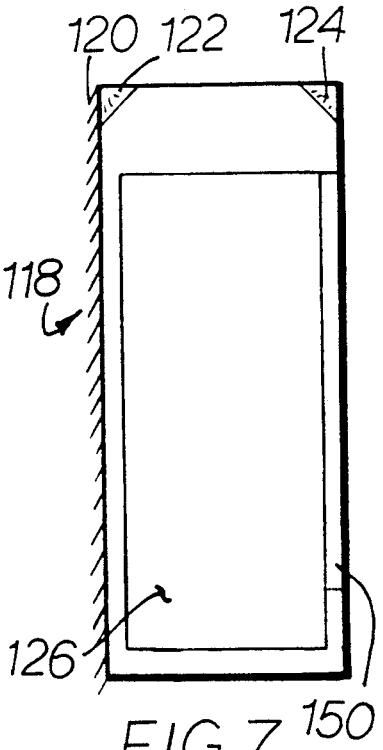
FIG. 7 is a plan view of an alternative embodiment of the present invention illustrated in FIG. 6.
Figure 8:
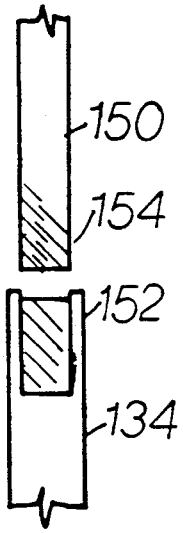
FIG. 8 is an enlarged exploded view of an applicator portion of an embodiment of the present invention.

Another preferred embodiment of the present invention is illustrated in FIGS. 6 through 8 and includes another package 118 having a 126 and a rear leaf 128. If desired, the package 118 can be manufactured with a longitudinal separation means 120, for example, such as that described for a previously described preferred embodiment of the present invention. Package 118 further includes opening means 122 and opposing opening means 124. As previously described for other preferred embodiments, an applicator means 130 within the package includes a swabbing means such as a swab 132 which can be a wedge of foam material as further described below. The applicator means further includes a holding means such as an applicator rod 134.

The front and rear leaves 126 and 128, are typically sealed together along an upper sealing means, a lower sealing means, one longitudinal sealing means, and an opposing longitudinal sealing means. A chamber means is defined by the sealed portions.

This preferred embodiment includes an upper marginal transverse adhesive peel strip 136, and a lower marginal transverse adhesive peel strip 138. The edge seals complete envelope closure and creation of at least one chamber. They include one longitudinal marginal adhesive peel strip 140 and another and opposing longitudinal marginal adhesive peel strip 142. These sealed margins define a swab containment pocket 144.

Opening means are provided in this embodiment at one openable corner 146 and an opposing openable corner 148. The openable corners are provided by defining an adhesive (or other sealing means) free zone.

This preferred package provides an opening means for revealing and providing access to the applicator rod 134 without breaking the seal of the swab containment pocket.

An applicator rod extender 150 removably attached to an exterior surface of package 118 provides for attachment to the applicator rod 134. The extender 150 particularly provides the user with means to effectively extend the exposed end of the applicator rod after a portion of the two leaves are separated prior to and in preparation to using the applicator as intended.

One arrangement of applicator rod and extension is illustrated in FIG. 8. The applicator rod 134 includes a rod extender receiving means such as a receiving pocket 152. The extender includes an insertion portion such as a narrowed end portion 154. It should be understood that the narrowed end portion and receiving pocket could be located on either the extender or the applicator rod. It will be further understood that equivalents of this attachment arrangement could be provided.

Figure 9:
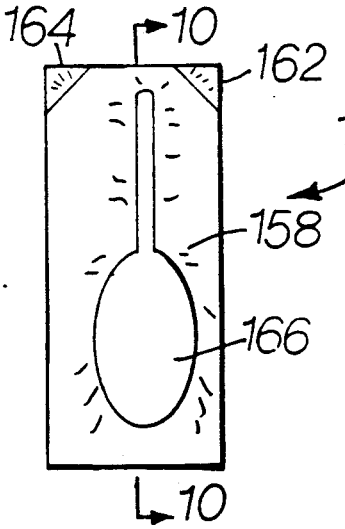
FIG. 9 is a plan view of another embodiment of the present invention.
Figure 10:
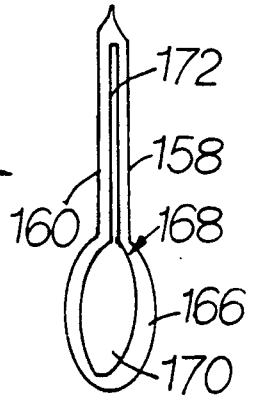
FIG. 10 is a cross-sectional view taken along line 10—10 in FIG. 9.

Another preferred embodiment of the present invention will now be described and reference is made to FIGS. 9 and 10 wherein a package 156 is illustrated. The package 156 has a front leaf 158 and a rear leaf 160. An applicator means 168 within the package includes a swabbing means such as a swab 170 which can be a wedge of foam material as further described below. The applicator means further includes a holding means such as an applicator rod 172.

The front and rear leaves are substantially sealed together over their entire surfaces except for two areas. The leaves are sealed together with the applicator means intermediate the leaves. The two unsealed areas are the location of the applicator rod 172 and a chamber means generally defined by the swab 170. In the preferred embodiment as described herein the sealed in swab defines a swab or polish containment pocket 166. As illustrated in the drawings, a sufficient portion of the opposing leaves can be separated so as to provide access to the applicator rod without breaking the seal of containment pocket 166.

Opening means are provided in this embodiment at one openable corner 162 and an opposing openable corner 164. Referring more specifically to FIG. 9 the corner portions 162 and 164 further indicate adhesive free zones intermediate front leaf 158 and rear leaf 160, respectively. It will be understood that the presently described preferred embodiment of the present invention again illustrates the features of the present invention that combine so as to allow the polish to remain in a sealed pocket while a user accesses and prepares to use the applicator.

Figure 11:
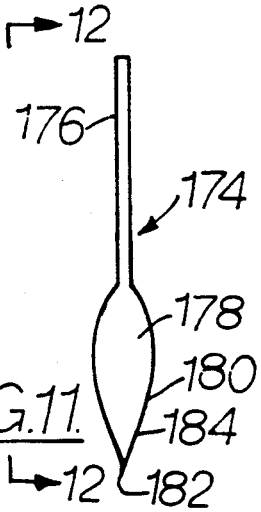
FIG. 11 is a side elevation view of an applicator.
Figure 12:
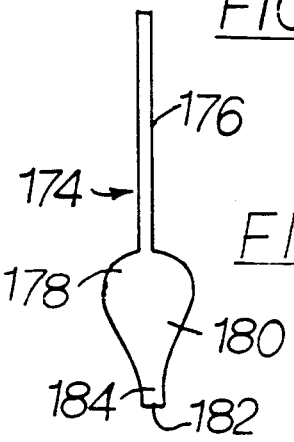
FIG. 12 is a front elevation view of the applicator illustrated in FIG. 11.

A preferred swab 174 as illustrated in FIGS. 11 and 12 include a holder 176 and applicator swab 178. The applicator swab includes a plurality of surfaces for ease of application and reduction of waste of polish. The swab contours provide a wide applicator portion 180, a fine applicator portion 182, and a medium width applicator portion 184.

In operation, in connection with a sealed container or envelope or package and applicator combination for providing shoe polish in single application amounts, leaves are provided and suitable adhesive is applied to adhesive zones and areas as previously described. An applicator with swab is placed in an appropriate location, see drawing figures, and an extension rod is added if desired. The opposing leaf is placed in registration with the other leaf and the leaves are sealed at the adhesive zones and locations or their equivalents as previously described.

The envelopes can be packaged singly or in groups as illustrated in FIG. 1. If packaged in groups, then a separation means will be provided.

While specific embodiments have been shown and described, many variations are possible. The applicator and package combination has at least one sealed pocket or swab containment chamber that can be opened to provide access to an applicator without opening the sealed chamber or pocket. The combination can have one or more sealed chambers as defined by marginal and intermediate sealing zones. The use of a suitable adhesive can be substituted for by one skilled in the art. For example, a heat seal process could also give the desired seal that will prolong the shelf life of the material in the sealed chamber, e.g., shoe polish. The double leaf, front and rear, arrangement could be varied depending upon the chamber arrangement desired. Whether individual packages or strips of separable packages are manufactured from individual leaves, multi-layer webs, stacks of leaves, it is to be understood from the foregoing description that variations can be manufactured. This invention is not concerned with how the combination is assembled but that assembly is accomplished via the use of modified conventional assembly machines in which standard well-known procedures are re-arranged to manufacture the inventive combination. For that reason disclosure of such conventional machinery is not deemed to be necessary. Accordingly, the foregoing detailed description does not include explanation of a particular apparatus used to accomplish manufacture of a particular preferred embodiment of the present invention. Therefore, for purposes of simplicity and clarity no other mention has been made of the fact that a particular manufacture apparatus is not shown.

Having described the invention in detail, those skilled in the art will appreciate that modifications may be made of the invention without departing from its spirit. Therefore, it is not intended that the scope of the invention be limited to the specific embodiments illustrated and described. Rather, it is intended that the scope of the invention be determined by the appended claims and their equivalents.

What is claimed is:

1. An applicator and package combination, comprising:

a generally flexible envelope including a generally flexible front leaf and a generally flexible rear leaf, the front and rear leaves being interchangeable and sealed in an opposing manner, the sealed leaves defining at least one sealed chamber;

a fluid contained within the sealed chamber;

applicator means contained within the sealed chamber having a portion extending through the sealing means without breaking the seal; and opening means for opening the envelope and providing access to the applicator means, the opening means allowing partial separation of the front leaf from the rear leaf so as to allow access to an exposed portion of the applicator means without separating the front leaf and the rear leaf into the sealed chamber, thereby providing access to the exposed portion of the applicator means without releasing a significant portion of the fluid.

2. An applicator and package combination as set forth in claim 1 wherein the front leaf margin and the rear leaf margin are sealed together so as to form the chamber.

3. An applicator and package combination as set forth in claim 2 wherein the front and rear leaf margins are adhesively sealed.

4. An applicator and package combination as set forth in claim 3 including a non-sealed margin portion for providing opening means for opening the envelope.

5. An applicator and package combination as set forth in claim 2 wherein the applicator means includes swab means and holding means and the opening means provides access to the holding means portion of the applicator means.

6. An applicator and package combination as set forth in claim 5 wherein the holding means includes a holding rod portion and the swab means including a swab portion.

7. An applicator and package combination as set forth in claim 6 including a holding rod extender coupled to the holding rod portion.

8. An applicator and package combination as set forth in claim 7 wherein the holding rod extender is removably attached to the holding rod outside of the chamber.

9. An applicator and package combination as set forth in claim 6 wherein the swab portion provides different width swabbing surfaces.

10. An applicator and package combination as set forth in claim 9 wherein the swab portion is a liquid adsorbing, small pored, dense material.

11. An applicator and package combination as set forth in claim 1 wherein the envelope is generally provided with at least one corner portion with the opening means located at the corner portion for ease of use.

12. An applicator and package combination as set forth in claim 1 wherein a plurality of envelopes are provided with intermediate separation means.

13. An applicator and package combination, comprising:

generally flexible interchangeable sheet members providing a plurality of contiguous sealed chamber means, at least one sealed chamber means defined by sealing means for sealing opposing interchangeable, generally flexible sheet members;

applicator means sealed within the sheet members, the applicator means in cooperative association with one or more sealed chamber means, the applicator means having a portion extending through the sealing means without breaking the seal; and opening means for facilitating the separation of the sheet members and providing access to the applicator means without opening the sealed chamber means.

14. An applicator and package combination as set forth in claim 13 wherein the sheet members define a multi-leaf assembly with at least a front leaf and an opposing rear leaf both having margin portions and opposing margin portions are sealed together so as to form the sealed chamber means.

15. An applicator and package combination as set forth in claim 13 including an upper chamber means and a lower chamber means, the upper chamber means defined by a top sealed margin, an intermediate sealed portion, a longitudinal sealed margin and another opposing longitudinal sealed margin, the lower chamber means defined by a bottom sealed margin, the intermediate sealed portion and the one and the other opposing longitudinal sealed margins.

16. An applicator and package combination as set forth in claim 15 wherein the applicator means includes a swabbing means for applying a swabbable material held by a holding means for holding and using the swabbing means.

17. An applicator and package combination as set forth in claim 15 wherein the applicator means holds a swabbable shoe polish.

18. An applicator and package combination as set forth in claim 15 including a barrier means within at least one chamber means for providing a barrier and seal against leakage of a fluid from the applicator means, whereby the barrier within the chamber means provides protection against leakage subsequent to opening the envelope and before removing the applicator means in order that the applicator means removal is generally free from contamination by a material intended to be restricted to the chamber means prior to applicator means removal.

19. An applicator and package combination as set forth in claim 18 wherein the barrier means is a wall member having a generally planar member and opposing marginal flange sealing means sealingly attached to the leaf member opposing faces, the opposing marginal flange sealing means compressed at generally opposing end portions and sealingly fastened between opposing longitudinal sealed margins.

20. An applicator and package combination as set forth in claim 15 wherein a portion of the applicator means extending out of the chamber means is sealingly held in the package by the intermediate sealing portion.

21. An applicator and package combination as set forth in claim 20 having an opening means further including a transverse separation means, whereby transverse separation along the transverse separation means provides access to the applicator means without opening the sealed chamber means.

22. An applicator and package combination as set forth in claim 13 wherein a plurality of packages are provided with intermediate longitudinal separation means.

* * * * *